US008721296B1

(12) United States Patent
Wang

(10) Patent No.: US 8,721,296 B1
(45) Date of Patent: May 13, 2014

(54) HAND PUMP WITH AIR STORAGE TANK

(71) Applicant: Lo Pin Wang, Taichung (TW)

(72) Inventor: Lo Pin Wang, Taichung (TW)

(73) Assignee: Beto Engineering & Marketing Co., Ltd., Beitun Taichung (TW)

( * ) Notice: Subject to any disclaimer, the term of this patent is extended or adjusted under 35 U.S.C. 154(b) by 0 days.

(21) Appl. No.: 13/751,184

(22) Filed: Jan. 28, 2013

(51) Int. Cl.
*F04B 49/00* (2006.01)

(52) U.S. Cl.
USPC ..... 417/63; 417/510; 417/562; 141/18; 137/565.15; 137/565.25

(58) Field of Classification Search
USPC ..... 137/565.01, 565.11, 565.12, 565.15, 137/227, 565.25; 417/278, 279, 305, 63, 417/296, 559, 234, 510, 514, 545, 553, 417/562; 141/18
See application file for complete search history.

(56) References Cited

U.S. PATENT DOCUMENTS

| | | | | |
|---|---|---|---|---|
| 5,590,696 | A * | 1/1997 | Phillips et al. | 141/47 |
| 6,652,242 | B2 * | 11/2003 | Wu | 417/63 |
| 6,676,390 | B2 * | 1/2004 | Wang | 417/528 |
| 6,883,565 | B2 | 4/2005 | Marui | |

* cited by examiner

*Primary Examiner* — John K Fristoe, Jr.
*Assistant Examiner* — Angelisa Hicks
(74) *Attorney, Agent, or Firm* — Charles E. Baxley

(57) ABSTRACT

A hand pump includes a base having an inlet opening and an outlet opening, a manual pump disposed on the base and communicating with the inlet opening of the base, a receptacle disposed on the base and communicating with the outlet opening of the base, a casing disposed on the receptacle and having a passage coupled to the outlet opening of the base and having a channel coupled to the receptacle and having a pathway formed between the passage and the channel of the casing, and an outlet hole communicated with the channel of the casing, a valve shank is slidably engaged in the channel of the casing for selectively blocking and sealing the outlet hole of the casing.

12 Claims, 6 Drawing Sheets

HAND PUMP WITH AIR STORAGE TANK

BACKGROUND OF THE INVENTION

1. Field of the Invention

The present invention relates to a hand pump or air pump for inflating the inflatable tires or objects or the like of the cycles, such as the bicycles, and more particularly to a hand pump or air pump for a bicycle including an air storage tank having a control valve device for controlling the outward supplying of the pressurized air and for allowing the pressurized air to be easily controlled and operated or supplied out to inflate the inflatable tires or objects or the like.

2. Description of the Prior Art

Typical hand pumps or air pumps or manual pumps comprise a tubular or cylindrical housing including a stand attached or mounted or secured to the bottom portion thereof for supporting the tubular or cylindrical housing in or at an upright status, and a handle attached or mounted or secured to the upper portion thereof for actuating or operating the piston to move in a reciprocating action within the tubular or cylindrical housing in order to pump and to generate the pressurized air and to supply the pressurized air out of the tubular or cylindrical housing.

For example, U.S. Pat. No. 6,883,565 to Marui discloses one of the typical hand pumps or air pumps or manual pumps for the bicycles comprising a tubular or cylindrical housing including a bottom stand and an upper handle, and an air storage tank coupled to and communicating with the tubular or cylindrical housing for receiving and storing the pressurized air from the tubular or cylindrical housing of the manual pump and for selectively supplying the pressurized air to inflate the inflatable tires or objects or the like.

However, the users may not easily control and operate the manual pump and the air storage tank, or the manual pump and the air storage tank may not be easily actuated or operated or controlled by the user to supply the pressurized air out to inflate the inflatable tires or objects or the like, and the user have to switch or change many parts or elements or control members before the pressurized air may be supplied out to inflate the inflatable tires or objects or the like.

The present invention has arisen to mitigate and/or obviate the afore-described disadvantages of the conventional hand pumps or air pumps or manual pumps and the air storage tank combinations or assemblies.

SUMMARY OF THE INVENTION

The primary objective of the present invention is to provide a hand pump or air pump for a bicycle including an air storage tank having a control valve device for controlling the outward supplying of the pressurized air and for allowing the pressurized air to be easily controlled and operated or supplied out to inflate the inflatable tires or objects or the like.

The other objective of the present invention is to provide a hand pump or air pump for a bicycle including a control valve device having a handle coupled to an actuating rod for allowing the actuating rod to be easily and quickly and readily actuated and operated by the user with the handle.

In accordance with one aspect of the invention, there is provided a hand pump for a bicycle comprising a base including a conduit formed therein and having an inlet opening and an outlet opening, a manual pump including a housing disposed on the base, the housing including a chamber formed therein and communicating with the inlet opening of the base, a piston slidably received and engaged in the chamber of the housing, and a piston rod attached to the piston for actuating the piston to move along the chamber of the housing in a reciprocating action in order to pump and generate and supply a pressurized air out of the housing and into the inlet opening and the conduit of the base, a receptacle disposed on the base and including a compartment formed therein and communicating with the outlet opening of the base for selectively receiving the pressurized air from the conduit of the base, a casing disposed on the receptacle and including a passage having an inlet port coupled to the outlet opening of the base for guiding the pressurized air to flow between the conduit of the base and the passage of the casing, and including a channel and a mouth piece coupled to the compartment of the receptacle for guiding the pressurized air to flow between the channel of the casing and the compartment of the receptacle, the casing including a pathway formed and communicated between the passage and the channel of the casing, and an outlet hole communicated with the channel of the casing, a valve shank slidably engaged in the channel of the casing for selectively blocking and sealing the outlet hole of the casing, and including a bore formed in the valve shank and communicating with the channel and the pathway of the casing, and including an outlet opening formed in the valve shank and communicating with the bore of the valve shank for selectively communicating with the outlet hole of the casing and for selectively supplying the pressurized air out through the outlet hole of the casing when the valve shank is moved relative to the casing, and an actuating device including a rod pivotally received and engaged in the casing, and the rod including a cam member for selectively engaging with the valve shank and for moving the valve shank to selectively block and seal the outlet hole of the casing and to selectively open the outlet hole of the casing when the valve shank is moved relative to the casing.

The actuating device includes a space formed in the rod for selectively receiving and engaging with the valve shank. The casing includes a spring biasing member engaged with the valve shank for selectively biasing and moving and disengaging the outlet opening of the valve shank from the outlet hole of the casing.

The casing includes a valve seat formed therein and located and arranged between the channel of the casing and the compartment of the receptacle, and a valve piece is slidably received and engaged in the channel of the casing and engageable with the valve seat for selectively blocking and sealing the channel of the casing.

The valve shank includes a retaining member for engaging with the valve piece and for selectively moving the valve piece away from the valve seat with the valve shank. The casing includes a spring biasing member engaged between the valve piece and the valve shank for selectively biasing and forcing and moving the valve piece to engage with the valve seat. The spring biasing member is engaged between the valve piece and the retaining member of the valve shank.

The receptacle includes a cover attached in an upper portion of the receptacle for covering and sealing the compartment of the receptacle, and includes an orifice and an aperture formed in the cover and communicating with the compartment of the receptacle for engaging with the inlet port and the mouth piece of the casing respectively.

The casing includes a pressure gauge attached to the casing and engaged into the channel of the casing for sensing or detecting a pressure in the channel of the casing. The casing includes a bypass formed and communicated between the passage and the channel of the casing.

The casing includes a throttle valve attached to the casing and extendible into the passage of the casing for controlling a flowing quantity of the pressurized air through the passage of the casing. The casing includes a relief valve attached to the casing and engaged into the channel of the casing for relieving a pressure in the channel of the casing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
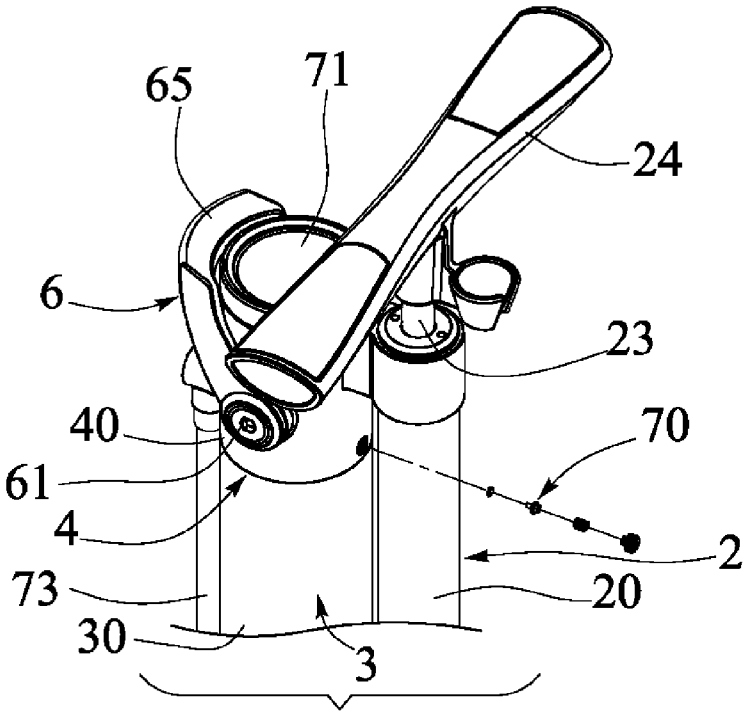
FIG. 1 is a partial exploded view of a hand pump or air pump in accordance with the present invention.
Figure 2:
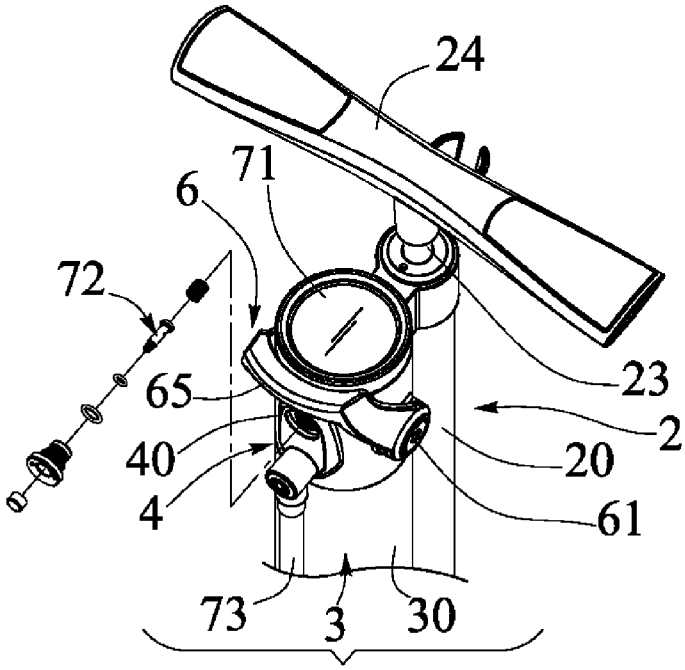
FIGS. 2, 3, 4 are other partial exploded views of the hand pump or air pump.
Figure 3:
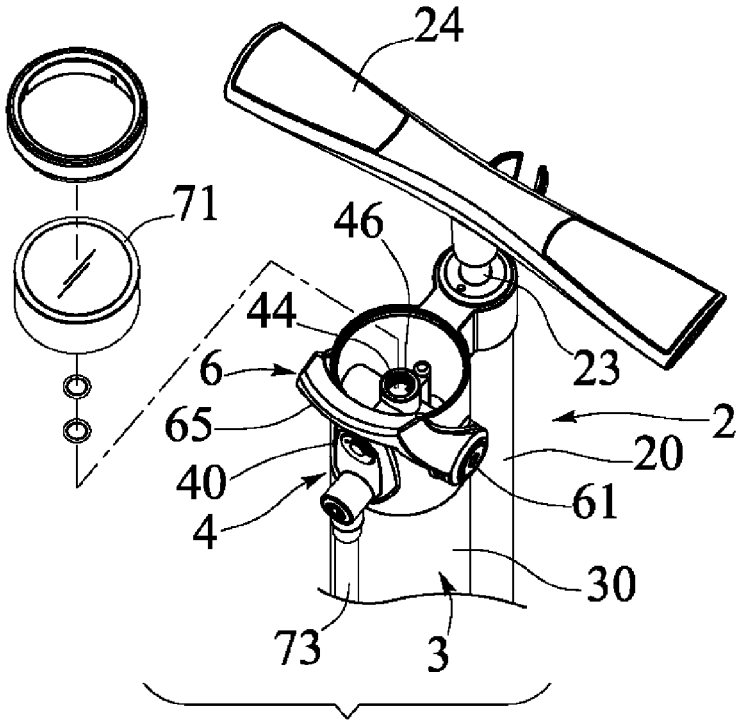

Referring to the drawings, and initially to FIGS. 5-8, a hand pump or air pump in accordance with the present invention comprises a stand or seat or base 10 including a U-shaped manifold or passage or conduit 11 formed therein and having an inlet opening 12 and an outlet opening 13 formed therein, such as formed in the upper portion thereof and faced or directed upwardly therefrom, and a manual pump 2 including a tubular or cylindrical housing 20 disposed or attached or mounted or secured on top of the base 10, the tubular or cylindrical housing 20 includes a chamber 21 formed therein and communicating with the inlet opening 12 of the base 10 for slidably receiving or engaging with a piston 22, and a piston rod 23 attached or mounted or secured to the piston 22 for actuating or operating the piston 22 to move along the chamber 21 of the housing 20.

For example, the piston rod 23 may be actuated or operated or moved by the user to actuate and move the piston 22 along the chamber 21 of the housing 20 in a reciprocating action in order to pump and to generate the pressurized air and to supply the pressurized air out of the housing 20 and for selectively filling or supplying the pressurized air into the inlet opening 12 and the conduit 11 of the base 10, a handle or hand grip 24 is further provided for attaching or mounting or securing or coupling to the piston rod 23 for actuating or operating the piston 22 to move along the chamber 21 of the housing 20 in the reciprocating action, and a control valve or check valve 25 is disposed or attached or mounted or secured in the housing 20 or in the base 10 and disposed or located and arranged between the chamber 21 of the housing 20 and the inlet opening 12 of the base 10 for controlling the pressurized air to flow only from the housing 20 to the conduit 11 of the base 10.

An air storage tank 3 includes a reservoir or container or receptacle 30 disposed or attached or mounted or secured on top of the base 10, the receptacle 30 includes a compartment 31 formed therein and communicating with the outlet opening 13 of the base 10 for selectively receiving the pressurized air from the conduit 11 of the base 10 and for allowing the manual pump 2 to selectively fill or supply the pressurized air to the conduit 11 of the base 10. The above-described structure or configuration for the housing 20 and the piston 22 of the manual pump 2 and the receptacle 30 of the air storage tank 3 is typical and will not be described in further details.

The air storage tank 3 includes a cap or lid or cover 32 attached or mounted or secured in the upper portion 33 of the receptacle 30 for covering or sealing the compartment 31 of the receptacle 30, and having an orifice 34 and an aperture 35 formed in the cover 32 and communicating with the compartment 31 of the receptacle 30.

The hand pump or air pump in accordance with the present invention further comprises a control valve device 4 including a housing or container or receptacle or casing 40 disposed or attached or mounted or secured on top of the receptacle 30 (FIGS. 1-8) and disposed or located and arranged above the cover 32 of the receptacle 30, the casing 40 of the control valve device 4 includes an inlet port 41 and a mouth piece 42 engaged into the orifice 34 and the aperture 35 of the cover 32 or of the receptacle 30 and attached or mounted or secured to the receptacle 30, and includes a bypass or manifold or passage 43 and a channel 44 formed in the casing 40 and communicating with or formed through the inlet port 41 and the mouth piece 42 respectively, in which the channel 44 of the casing 40 is formed through the mouth piece 42 and communicating with the compartment 31 of the receptacle 30.

The receptacle 30 includes a connecting or coupling tube 36 disposed or engaged in the compartment 31 thereof and attached or mounted or secured or located and arranged between the outlet opening 13 of the base 10 and the orifice 34 of the cover 32 for guiding the pressurized air to flow between the conduit 11 of the base 10 and the passage 43 of the casing 40. The casing 40 further includes a lateral pathway 45 and a lateral bypass 46 formed or located and arranged between the passage 43 and the channel 44 of the casing 40 for communicating the passage 43 and the channel 44 of the casing 40 with each other. A throttle valve 70 is attached or mounted or secured or engaged into the receptacle 30 or the casing 40 (FIG. 1) and extendible into the passage 43 of the casing 40 (FIGS. 5-8) for controlling or adjusting the flowing quantity of the pressurized air through the passage 43 of the casing 40.

A pressure gauge 71 is attached or mounted or secured or engaged into the casing 40 (FIGS. 1-3, 5-8) and engaged into the channel 44 of the casing 40 and communicating with the bypass 46 of the casing 40 for sensing or detecting or measuring and showing or displaying the pressure in the passage 43 and/or the channel 44 of the casing 40. A relief valve 72 is attached or mounted or secured or engaged into the casing 40 (FIGS. 2, 5-8) and communicating with the channel 44 of the casing 40 and/or the pressure gauge 71 for relieving the pressure of the pressurized air in the passage 43 and/or the channel 44 of the casing 40 when required. The casing 40 further includes a lateral outlet hole 47 formed therein and communicating with the channel 44 of the casing 40 for engaging with or connecting or coupling to a hose 73 which may be engaged with various kinds of air inflatable facilities or devices with a nozzle (not shown) for filling or supplying the pressurized air to inflate the inflatable facilities or devices.

As shown in FIGS. 4-8 and 5A-8A, a slidable valve stem or shank 50 is slidably received or engaged in the channel 44 of the casing 40, and includes a blind hole or bore 51 formed therein and communicating with the channel 44 and the pathway 45 of the casing 40, and includes a hook or gripping or retaining member 52 for slidably receiving or engaging with a valve piece 53, and the casing 40 includes a valve seat 48 formed therein (FIGS. 5A-8A) and located and arranged between the channel 44 of the casing 40 and the compartment 31 of the receptacle 30 for selectively engaging with the valve piece 53 which is engageable with the valve seat 48 for selectively blocking and sealing the air passage between the channel 44 of the casing 40 and the compartment 31 of the receptacle 30 and for controlling the pressurized air to flow between the channel 44 of the casing 40 and the compartment 31 of the receptacle 30.

The valve shank 50 includes an outlet opening 54 formed therein and communicating with the bore 51 of the valve shank 50 for selectively communicating with the outlet hole 47 of the casing 40 (FIGS. 5-6, 8, 5A-6A, 8A) and for selectively supplying the pressurized air out through the outlet hole 47 of the casing 40, and the outlet hole 47 of the casing 40 may be blocked and sealed by the valve shank 50 when the outlet opening 54 of the valve shank 50 is disengaged or separated from the outlet hole 47 of the casing 40, and a first or larger or greater spring biasing member 55 is disposed or engaged in the channel 44 of the casing 40 and engaged with the valve shank 50 for selectively biasing and forcing or moving the valve shank 50 away from the valve seat 48 (FIG. 7A) and for selectively separating or moving or disengaging the outlet opening 54 of the valve shank 50 from the outlet hole 47 of the casing 40.

Another or second or reduced or smaller spring biasing member 56 is disposed or engaged in the channel 44 of the casing 40 and engaged with or between the valve piece 53 and the valve shank 50, such as between the valve piece 53 and the retaining member 52 of the valve shank 50 for selectively biasing and forcing or moving the valve piece 53 to engage with the valve seat 48 and for selectively blocking and sealing the air passage between the channel 44 of the casing 40 and the compartment 31 of the receptacle 30 (FIGS. 5A, 6A), and arranged for allowing the pressurized air to selectively overcome and move and open the valve piece 53 (FIGS. 8, 8A) when the pressure of the pressurized air is greater than the spring biasing force of the spring biasing member 56, and the valve piece 53 may be moved and disengaged or separated from the valve seat 48 (FIGS. 7, 7A) when the spring biasing member 55 biases and moves the valve shank 50 away from the valve seat 48.

Figure 4:
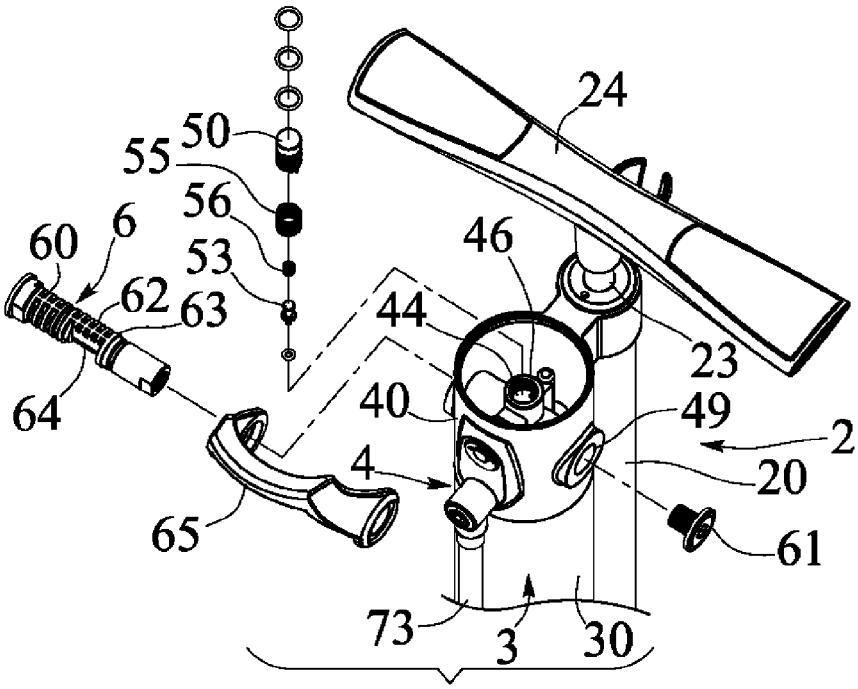

The casing 40 further includes a passage or conduit or pathway or groove 49 laterally formed therein (FIGS. 4-8 and 5A-8A) and intersecting or communicating with the channel 44 thereof and having a with or inner diameter greater than that of the channel 44 of the casing 40 for pivotally or rotatably receiving or engaging with an actuating device 6 which includes a stem or shank or rod 60 pivotally or rotatably received or engaged in the lateral groove 49 of the casing 40 and attached or mounted or secured to the casing 40 with such as a fastener 61, as shown in FIG. 4, the rod 60 includes a cam member 62 formed or provided in the middle or intermediate portion 63 thereof and having a recess or cam surface or depression or notch or space 64 formed therein for selectively receiving and engaging with the valve shank 50 (FIGS. 7, 7A) and for allowing the valve shank 50 to selectively block and seal the outlet hole 47 of the casing 40.

At this moment, the valve shank 50 may be moved and disengaged or separated from the valve seat 48 and to engage with the space 64 and/or the cam member 62 of the rod 60 of the actuating device 6 with or by the spring biasing member 55, and the valve piece 53 may be moved and disengaged or separated from the valve seat 48 with or by the valve shank 50 for allowing the pressurized air from the manual pump 2 to flow through the conduit 11 of the base 10, the coupling tube 36, and into the passage 43 and the pathway 45 and the channel 44 of the casing 40, and then into the compartment 31 of the receptacle 30 selectively. The actuating device 6 may further include a hand grip or handle 65, such as a U-shaped handle 65 attached or mounted or secured to the rod 60 and located and arranged out of the casing 40 for being grasped and actuated or operated by the user to actuate the cam member 62 to move the valve shank 50 and/or the valve piece 53 relative to the casing 40.

Figure 6A:
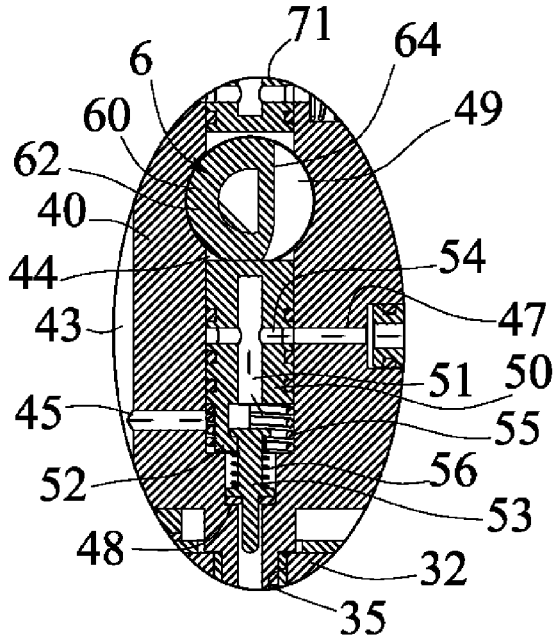
Figure 6:
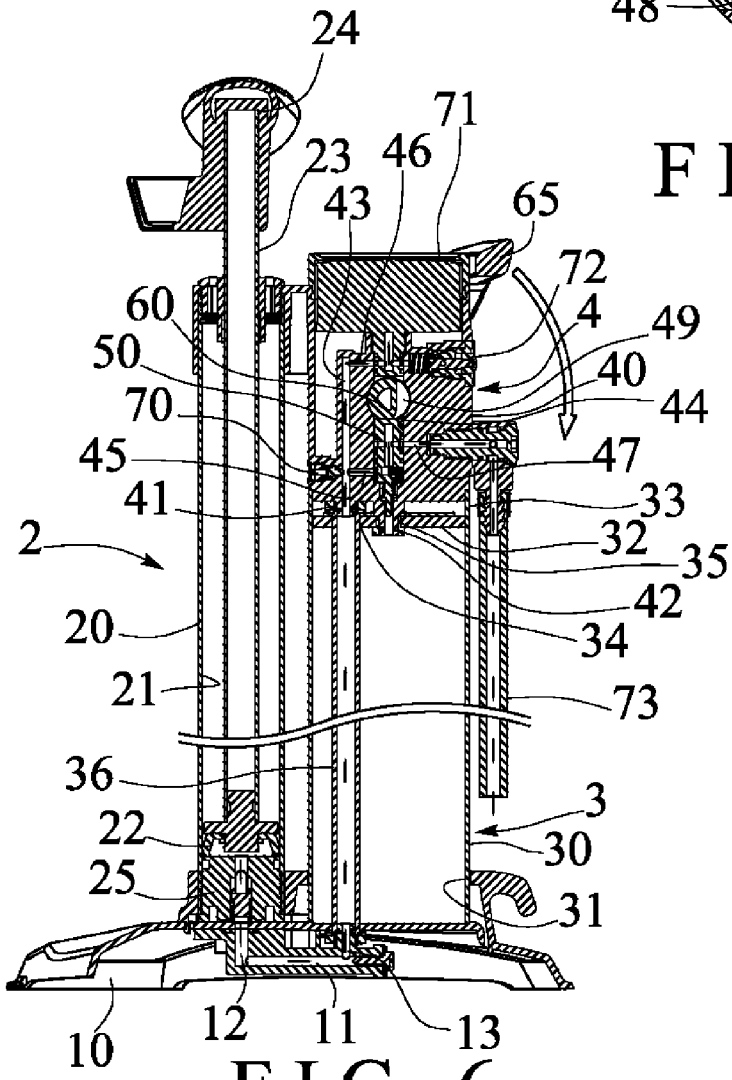

In operation, as shown in FIGS. 6 and 6A, when the outlet opening 54 of the valve shank 50 is aligned with or communicating with the outlet hole 47 of the casing 40, the pressurized air from the manual pump 2 may flow through the conduit 11 of the base 10, the coupling tube 36, and into the passage 43 and the pathway 45 and the channel 44 of the casing 40, and then into the bore 51 and the outlet opening 54 of the valve shank 50 for selectively supplying the pressurized air out through the outlet hole 47 of the casing 40 and the hose 73 in order to inflate the inflatable tires or objects or the like. At this moment, the valve piece 53 may be biased and forced by the spring biasing member 56 to engage with the valve seat 48 and to selectively block and seal the air passage between the channel 44 of the casing 40 and the compartment 31 of the receptacle 30, and thus to prevent the pressurized air from being supplied into the compartment 31 of the receptacle 30.

Figure 7A:
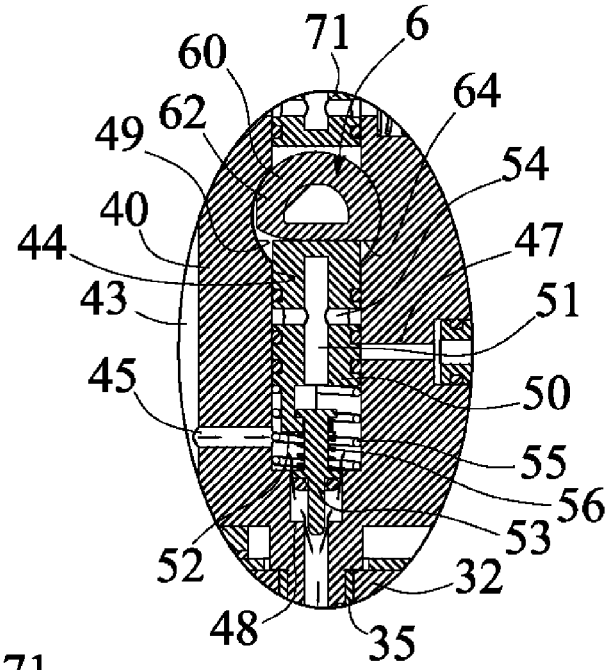
Figure 7:
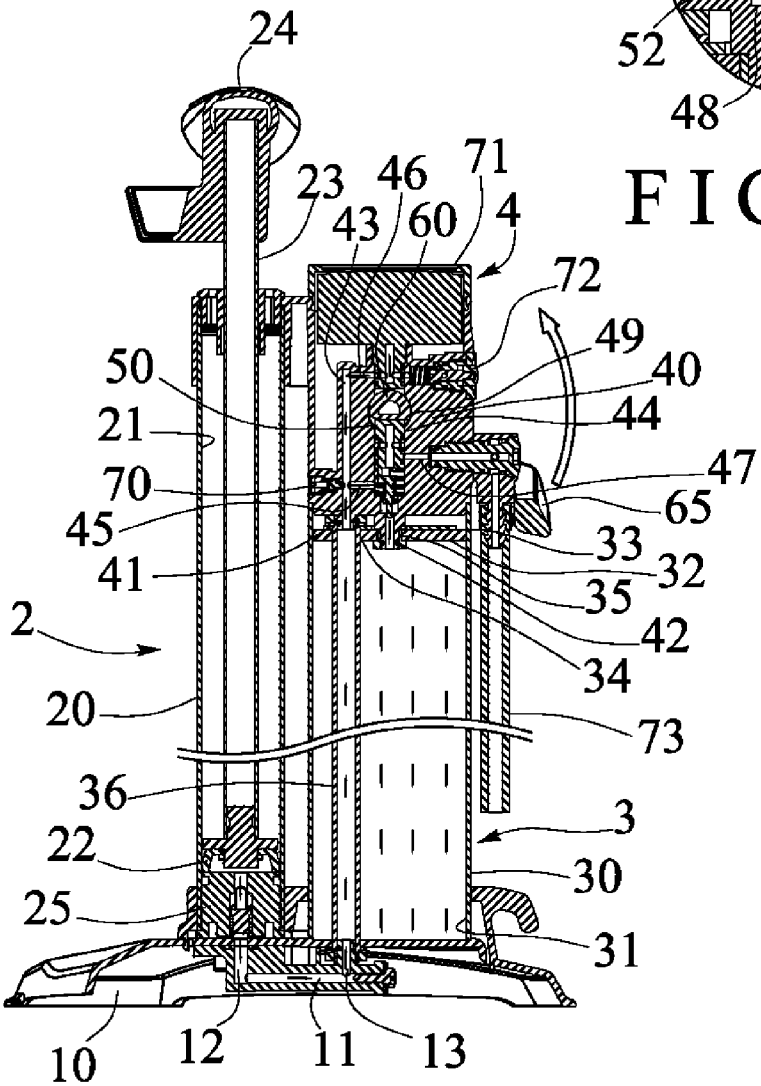

As shown in FIGS. 7 and 7A, when the rod 60 of the actuating device 6 is actuated or operated and pivoted or rotated relative to the casing 40 with the handle 65 to face or direct the cam member 62 and/or the space 64 of the rod 60 toward and to engage with the valve shank 50, the valve shank 50 may be biased and forced by the spring biasing member 56 to engage with and to block and seal the outlet hole 47 of the casing 40 and to prevent the pressurized air from being supplied out through the outlet hole 47 of the casing 40. Simultaneously, the valve shank 50 may also be moved to disengage or separate the valve piece 53 from the valve seat 48 for allowing the pressurized air from the manual pump 2 to flow into the coupling tube 36, and into the passage 43 and the pathway 45 and the channel 44 of the casing 40, and then into the compartment 31 of the receptacle 30 selectively in order to receive and store the pressurized air in the compartment 31 of the receptacle 30 selectively.

Figure 5A:
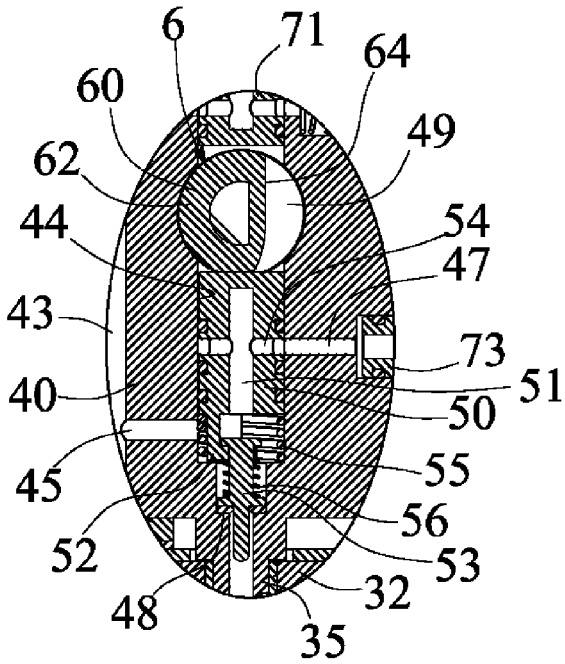
FIGS. 5A, 6A, 7A, 8A are enlarged partial cross sectional views of the hand pump or air pump as shown in FIGS. 5, 6, 7, 8 respectively.
Figure 5:
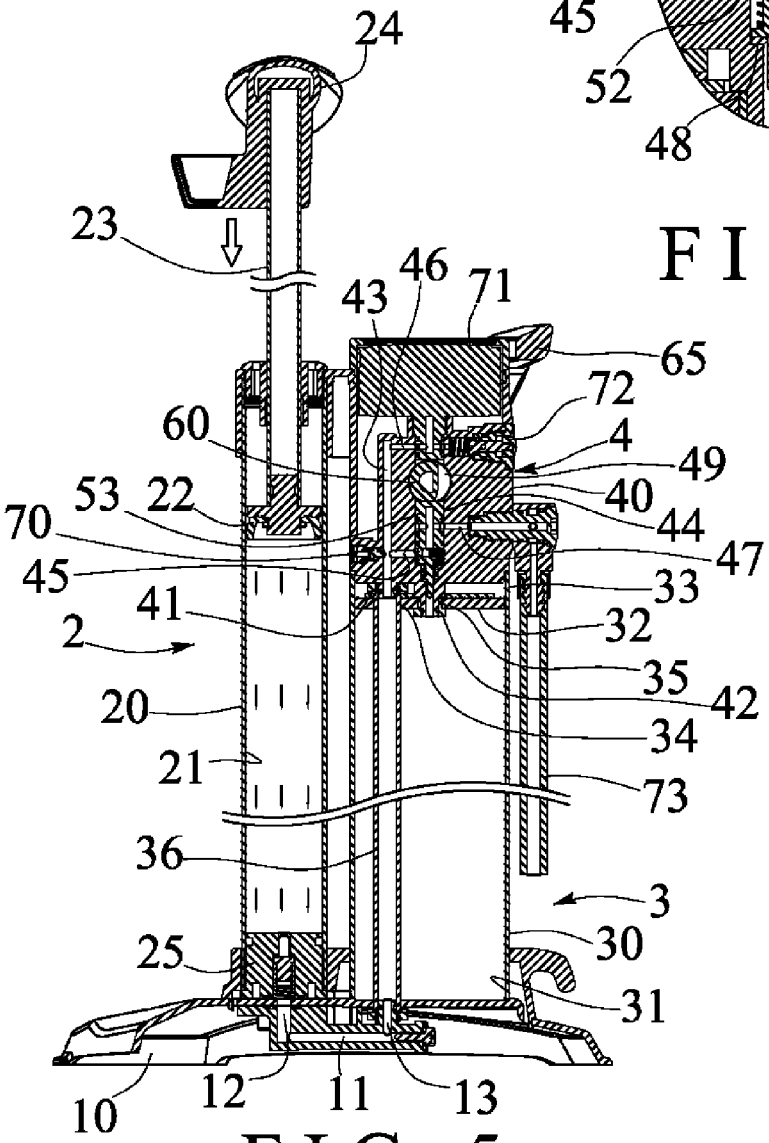
FIGS. 5, 6, 7, 8 are cross sectional views of the hand pump or air pump, illustrating the operation of the hand pump or air pump.
Figure 8A:
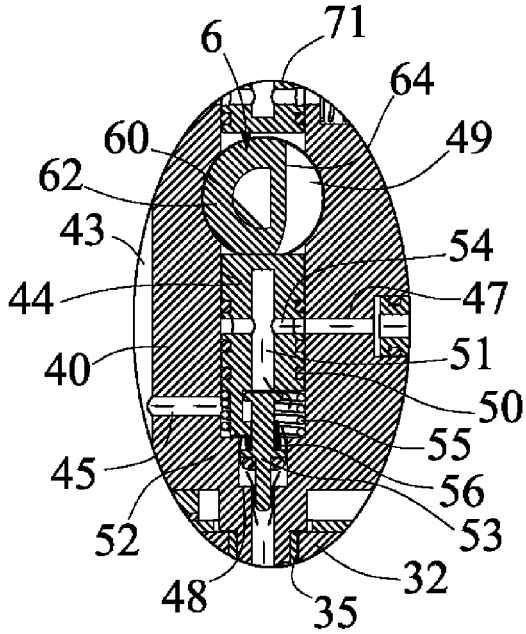
Figure 8:
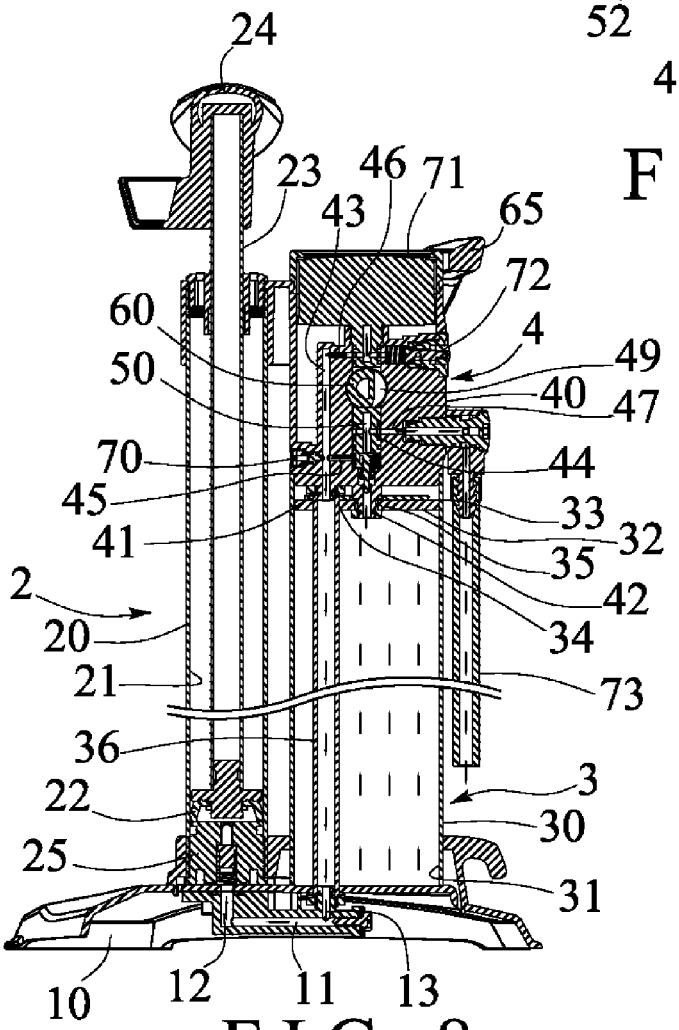

As shown in FIGS. 5 and 5A, when the rod 60 of the actuating device 6 is actuated or operated and pivoted or rotated relative to the casing 40 with the handle 65 to face or direct the cam member 62 of the rod 60 toward and to engage with the valve shank 50 again, the valve piece 53 may be moved toward the valve seat 48 and may be biased and forced by the spring biasing member 56 to engage with the valve seat 48 and to block and seal the air passage between the channel 44 of the casing 40 and the compartment 31 of the receptacle 30, and thus to retain and store the pressurized air in the compartment 31 of the receptacle 30 selectively. As shown in FIGS. 8 and 8A, when the pressure in the compartment 31 of the receptacle 30 is greater than the spring biasing force of the spring biasing member 56, the pressurized air may overcome the spring biasing member 56 and may selectively open the valve piece 53 for allowing the pressurized air to be selectively supplied from the compartment 31 of the receptacle 30 into the channel 44 of the casing 40 and the bore 51 of the valve shank 50, and then into the outlet opening 54 of the valve shank 50 for selectively supplying the pressurized air out through the outlet hole 47 of the casing 40 and the hose 73 in order to inflate the inflatable tires or objects or the like.

It is to be noted that when the pressure in the compartment 31 of the receptacle 30 is greater enough to supply the pressurized air out through the outlet hole 47 of the casing 40 and the hose 73 as shown in FIGS. 8 and 8A, the manual pump 2 may also be actuated or operated by the user to actuate the piston 22 to move along the chamber 21 of the housing 20 in the reciprocating action in order to pump and to generate the pressurized air and to further supply the pressurized air through the conduit 11 of the base 10, the coupling tube 36, and into the passage 43 and the pathway 45 and the channel 44 of the casing 40, and then into bore 51 of the valve shank 50, and then into the outlet opening 54 of the valve shank 50 for further supplying the pressurized air out through the outlet hole 47 of the casing 40 and the hose 73 in order to inflate the inflatable tires or objects or the like.

It is further to be noted that the rod 60 may be easily and quickly and readily pivoted or rotated relative to the casing 40 with the handle 65 to actuate and operate the space 64 and/or the cam member 62 of the rod 60 of the actuating device 6 to engage with the valve shank 50, in order to move the valve shank 50 relative to the casing 40 so as to selectively align the outlet opening 54 of the valve shank 50 with the outlet hole 47 of the casing 40 (FIGS. 5-6, 8, 5A-6A, and 8A), or to selectively disengage or separate the outlet opening 54 of the valve shank 50 from the outlet hole 47 of the casing 40, for allowing the pressurized air to be pumped and generated by or with the manual pump 2 and directly supplied out through the outlet hole 47 of the casing 40 and the hose 73 (FIGS. 6, 6A) in order to inflate the inflatable tires or objects or the like, or retained and stored in the compartment 31 of the receptacle 30 selectively (FIGS. 7, 7A), or to allow the pressurized air to be selectively supplied out through the outlet hole 47 of the casing 40 and the hose 73 from the compartment 31 of the receptacle 30 and/or from the manual pump 2 simultaneously.

Accordingly, the hand pump or air pump in accordance with the present invention includes an air storage tank having a control valve device for controlling the outward supplying of the pressurized air and for allowing the pressurized air to be easily controlled and operated or supplied out to inflate the inflatable tires or objects or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand pump comprising:

a base including a conduit formed therein and having an inlet opening and an outlet opening, a manual pump including a housing disposed on said base, said housing including a chamber formed therein and communicating with said inlet opening of said base, a piston slidably received and engaged in said chamber of said housing, and a piston rod attached to said piston for actuating said piston to move along said chamber of said housing in a reciprocating action in order to pump and generate and supply a pressurized air out of said housing and into said inlet opening and said conduit of said base, a receptacle disposed on said base and including a compartment formed therein and communicating with said outlet opening of said base for selectively receiving the pressurized air from said conduit of said base, a casing disposed on said receptacle and including a passage having an inlet port coupled to said outlet opening of said base for guiding the pressurized air to flow between said conduit of said base and said passage of said casing, and including a channel and a mouth piece coupled to said compartment of said receptacle for guiding the pressurized air to flow between said channel of said casing and said compartment of said receptacle, said casing including a pathway formed and communicated between said passage and said channel of said casing, and an outlet hole communicated with said channel of said casing, a valve shank slidably engaged in said channel of said casing for selectively blocking and sealing said outlet hole of said casing, and including a bore formed in said valve shank and communicating with said channel and said pathway of said casing, and including an outlet opening formed in said valve shank and communicating with said bore of said valve shank for selectively communicating with said outlet hole of said casing and for selectively supplying the pressurized air out through said outlet hole of said casing when said valve shank is moved relative to said casing, and an actuating device including a rod pivotally received and engaged in said casing, and said rod including a cam member for selectively engaging with said valve shank and for moving said valve shank to selectively block and seal said outlet hole of said casing and to selectively open said outlet hole of said casing.

2. The hand pump as claimed in claim 1, wherein said actuating device includes a space formed in said rod for selectively receiving and engaging with said valve shank.

3. The hand pump as claimed in claim 1, wherein said casing includes a spring biasing member engaged with said valve shank for selectively biasing and moving and disengaging said outlet opening of said valve shank from said outlet hole of said casing.

4. The hand pump as claimed in claim 1, wherein said casing includes a valve seat formed therein and located and arranged between said channel of said casing and said compartment of said receptacle, and a valve piece slidably engaged in said channel of said casing and engageable with said valve seat for selectively blocking and sealing said channel of said casing.

5. The hand pump as claimed in claim 4, wherein said valve shank includes a retaining member for engaging with said valve piece and for selectively moving said valve piece away from said valve seat with said valve shank.

6. The hand pump as claimed in claim 5, wherein said casing includes a spring biasing member engaged between said valve piece and said valve shank for selectively biasing and forcing and moving said valve piece to engage with said valve seat.

7. The hand pump as claimed in claim 6, wherein said spring biasing member is engaged between said valve piece and said retaining member of said valve shank.

8. The hand pump as claimed in claim 1, wherein said receptacle includes a cover attached in an upper portion of said receptacle for covering and sealing said compartment of said receptacle, and includes an orifice and an aperture formed in said cover and communicating with said compartment of said receptacle for engaging with said inlet port and said mouth piece of said casing respectively.

9. The hand pump as claimed in claim 1, wherein said casing includes a pressure gauge attached to said casing and engaged into said channel of said casing for detecting a pressure in said channel of said casing.

10. The hand pump as claimed in claim 9, wherein said casing includes a bypass formed and communicated between said passage and said channel of said casing.

11. The hand pump as claimed in claim 1, wherein said casing includes a throttle valve attached to said casing and extendible into said passage of said casing for controlling a flowing quantity of the pressurized air through said passage of said casing.

12. The hand pump as claimed in claim 1, wherein said casing includes a relief valve attached to said casing and engaged into said channel of said casing for relieving a pressure in said channel of said casing.

* * * * *